United States Patent [19]

Walker

[11] Patent Number: 4,641,751

[45] Date of Patent: Feb. 10, 1987

[54] COSMETIC CARRIER WITH REMOVABLE RESILIENT RETAINING MEANS

[76] Inventor: Mildred W. Walker, 2188 Johnson Dr., Ventura, Calif. 93003

[21] Appl. No.: 815,721

[22] Filed: Jan. 2, 1986

Related U.S. Application Data

[63] Continuation-in-part of Ser. No. 707,752, Mar. 4, 1985, abandoned.

[51] Int. Cl.[4] ..... A45D 34/00; B65D 81/08

[52] U.S. Cl. ..... 206/478; 206/479; 206/235; 206/581; 206/823; 150/112; 150/113; 190/110; 217/22; 220/22.1; 220/22.2; 132/79 F

[58] Field of Search ..... 150/112, 113, 48; 190/110, 100; 206/478, 479, 570, 581, 203, 235, 823, 542, 193, 196; 217/22; 383/38; 229/28 BC; 220/22.1, 22.2; 132/79 F, 82 F, 79 R

[56] References Cited

U.S. PATENT DOCUMENTS

| | | | |
|---|---|---|---|
| 1,614,108 | 1/1927 | Deitsch | 190/110 |
| 1,723,740 | 8/1929 | Lewis | 150/112 X |
| 2,068,051 | 1/1937 | Lewis | 150/113 |
| 2,183,428 | 12/1939 | McNary | 206/479 X |
| 2,542,640 | 2/1951 | Dixon | 206/478 |
| 2,604,917 | 7/1952 | Reilly | 150/113 |
| 2,804,969 | 9/1957 | Barnett | 206/570 X |
| 3,302,679 | 2/1967 | Padovani | 150/48 |
| 3,696,850 | 10/1972 | Rosenblum | 190/110 X |
| 3,831,651 | 8/1974 | Leahy | 150/112 X |
| 4,250,938 | 2/1981 | Siegel | 150/113 X |

FOREIGN PATENT DOCUMENTS

| | | | |
|---|---|---|---|
| 18401 | 2/1930 | Australia | 190/110 |
| 364022 | 11/1922 | Fed. Rep. of Germany | 206/479 |
| 993895 | 8/1951 | France | 190/100 |
| 1154 | of 1881 | United Kingdom | 217/22 |
| 1598 | of 1915 | United Kingdom | 217/22 |
| 441860 | 1/1936 | United Kingdom | 383/38 |

*Primary Examiner*—William Price
*Assistant Examiner*—Sue A. Weaver
*Attorney, Agent, or Firm*—Jacobs & Streck

[57] ABSTRACT

A cosmetic carrier adapted for use alone or for placement in the bottom of a larger container to contain a plurality of cosmetic bottles and the like from bumping and tipping in transit. The carrier comprises an open topped resiliently rigid container having sidewalls and a bottom. A vertically disposed ribbon of elastic material horizontally crisscrosses the container between a plurality of first points on one area of the sidewalls and a plurality of second points disposed between the first points on a second area of the sidewalls opposite the first area to create a plurality of generally triangular areas within the container each being bounded on two sides by the elastic material and on a third side by a portion of the sidewalls. A plurality of first fastening means are provided for fastening the elastic material to the sidewalls at the first and second points and a plurality of releasable second fastening means are attached to the elastic material at a plurality of opposed points along the material between the first and second points whereby the triangular areas can be releasably subdivided to contain smaller articles by fastening opposed ones of the fastening means.

8 Claims, 5 Drawing Figures

COSMETIC CARRIER WITH REMOVABLE RESILIENT RETAINING MEANS

This application is a continuation-in-part of application Ser. No. 707,752, filed Mar. 4, 1985, now abandoned.

BACKGROUND OF THE INVENTION

The present invention relates to containers for protectively carrying a plurality of loose articles such as bottles and other cosmetic containers and, more particularly, to a cosmetic carrier adapted for use alone or for placement in the bottom of a larger container to contain a plurality of cosmetic bottles and the like from bumping and tipping in transit comprising, an open topped resiliently rigid container having sidewalls and a bottom; a vertically disposed ribbon of elastic material horizontally crisscrossing the container between a plurality of first points on one area of the sidewalls and a plurality of second points disposed between the first points on a second area of the sidewalls opposite the first area to create a plurality of generally triangular areas within the container, each being bounded on two sides by the elastic material and on a third side by a portion of the sidewalls; a plurality of first fastening means for fastening the elastic material to the sidewalls at the first and second points; and, a plurality of releasable second fastening means attached to the elastic material at a plurality of opposed points along the material between the first and second points whereby the triangular areas can be releasably subdivided to contain smaller articles by fastening opposed ones of the fastening means.

When travelling, women generally transport a number of small, odd shaped bottles and other containers for their cosmetics, shampoo, etc. Typically, these are placed in a piece of luggage such as the so-called "train case" shown in FIGS. 1 and 2 and generally indicated therein as 10. Train case 10 has an open box-shaped bottom portion 12 to which is attached a hinged lid 14 with a carrying handle 16 and a closing latch 18. Usually, a removable divided tray 20 is provided which sits on the top edge 22 by means of a lip 24 on its two ends. Sometimes, a strip of elastic material 26 is attached to the inside of the lid 14, or the like, at several locations so that small articles, such as bottle 28, can be held between the elastic material 26 and the lid 14 as shown in FIG. 1.

In use, the cosmetic containers (not shown) are merely placed in the bottom portion 12. Often facial tissue or something similar is jammed between the containers in an attempt to render them immobile. If there are insufficient containers to use tissue, or some larger substitute, or the effort is not made for some reason, the containers bounce, bump, and tip—often resulting in spilling and mess within the case 10. To date, despite many advances and innovations in the luggage art, no better method for containing these bottles, jars, etc. has been available.

Wherefore, it is the object of the present invention to provide a carrier for cosmetics, and the like, which can be placed within another container, such as train case 10, or be used alone, to provide a safe, convenient and effective means for their transport.

SUMMARY

The foregoing object has been attained by the cosmetic carrier of the present invention which is adapted for use alone or for placement in the bottom of a larger container to contain a plurality of cosmetic bottles and the like from bumping and tipping in transit and which comprises, an open topped resiliently rigid container having sidewalls and a bottom; a vertically disposed ribbon of elastic material horizontally crisscrossing the container between a plurality of first points on one area of the sidewalls and a plurality of second points disposed between the first points on a second area of the sidewalls opposite the first area to create a plurality of generally triangular areas within the container each being bounded on two sides by the elastic material and on a third side by a portion of the sidewalls; a plurality of first fastening means for fastening the elastic material to the sidewalls at the first and second points; and, a plurality of releasable second fastening means attached to the elastic material at a plurality of opposed points along the material between the first and second points whereby the triangular areas can be releasably subdivided to contain smaller articles by fastening opposed ones of the fastening means.

DESCRIPTION OF THE PREFERRED EMBODIMENT

Figure 1:
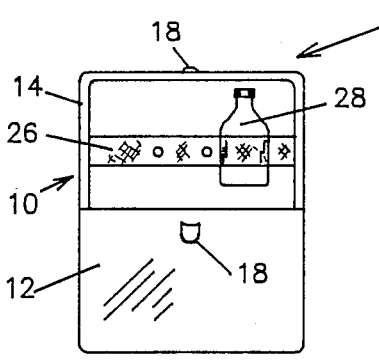
FIG. 1 is a front elevation view of a prior art train case as wherein the present invention is particularly adapted for use.
Figure 2:
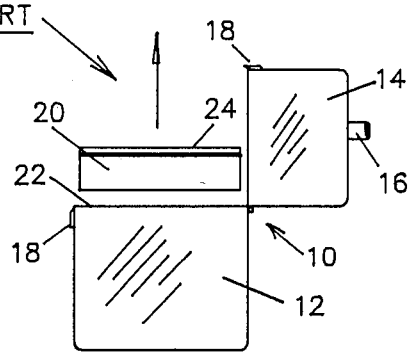
FIG. 2 is a side elevation of the train case of FIG. 1.
Figure 3:
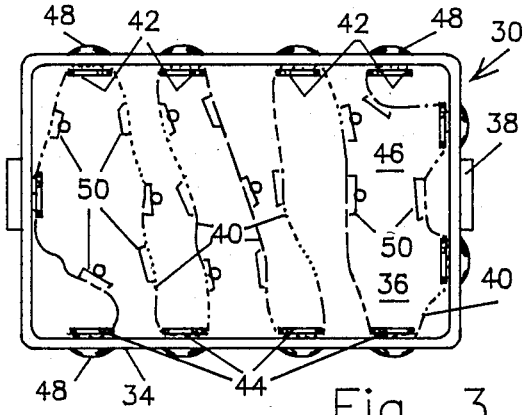
FIG. 3 is a top view of the cosmetic carrier of the present invention showing the elastic strip thereof as originally attached to the container.
Figure 4:
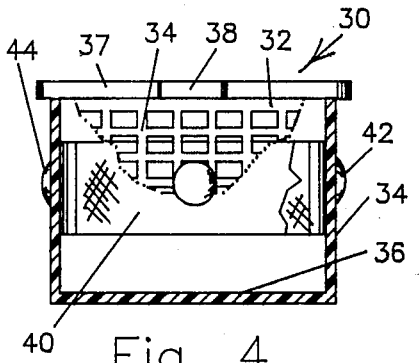
FIG. 4 is a partially cut away end view of the cosmetic carrier of FIG. 3.

Turning first to FIGS. 3 and 4, the cosmetic carrier of the present invention is generally indicated as 30. Carrier 30 comprises an open topped resiliently rigid container 32 having sidewalls 34 and a bottom 36. In the preferred embodiment, the container 30 is of injection molded plastic and has open mesh sides for ease of cleaning. The top edge has a reinforcing lip 37 circumferentially thereabout with lifting handles 38 formed therein. While the preferred embodiment as tested and described herein is rectangular in shape, the novel features of the present invention could be provided equally in a container of round or oval shape, for example. A lid (hinged or removable) could also be provided, if desired, particularly if the carrier is to be used independently, i.e. not be placed within another container.

Within the container 30, a vertically disposed ribbon of elastic material 40 horizontally crisscrosses the container 30 in a serpentine path between a plurality of first points 42 on one area of the sidewalls 34 and a plurality of second points 44 disposed between the first points 42 on a second area of the sidewalls 34 opposite the first area to create a plurality of generally triangular areas 46 within the container 30. In a rectangular container such as that shown herein, the first and second areas of the sidewalls 34 are, of course, opposed sides. Note that, in general, each of the triangular areas 46 is bounded on two sides by a strip of the elastic material 40 and on a third side by a portion of the sidewalls 34.

A plurality of first fasteners 48 are used for fastening the elastic material 40 to the sidewalls 34 at the first and second points 42, 44. In the preferred embodiment, the first fasteners 48 are snaps or other releasable fasteners so that the elastic material 40 can be completely removed for washing and so that the inside of the container 32 can be cleaned easily. While not preferred, permanent fasteners, such as rivets, could be used as the first fasteners 48.

A plurality of releasable second fasteners 50 are attached to the elastic material 40 at a plurality of opposed points along the length of the material between the first and second points 42, 44, whereby the triangular areas 46 can be releasably subdivided into smaller areas to contain smaller articles by fastening opposed ones of the fasteners 50 together. In the preferred embodiment, metal snaps are used as the fasteners 50 with a male portion on one strip of the material 40 being positioned opposite a female portion on the next adjacent strip of the material 40. Other releasable fasteners could, of course, be used within the scope a spirit of the present invention. For example, dots or strips of the fastening material sold under the tradename Velcro could also be used if desired.

Figure 5:
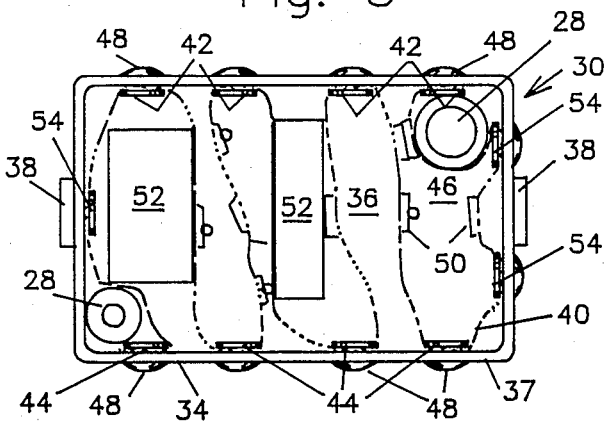
FIG. 5 is a top view in the manner of FIG. 3 showing the cosmetic carrier of the present invention with some of the intermediate releasable fasteners on the elastic strips fastened together so as to provide customized containing areas for articles to be transported.

The manner of use of the present invention is shown in FIG. 5. Selected ones of the second fasteners 50 (i.e., the snaps) are fastened together to subdivide some of the triangular areas 46 as necessary to create smaller areas for positively gripping articles such as the bottles 28 and boxes 52. As can be seen, for larger articles, the complete width of the container 32 is employed. To provide additional areas adjacent the ends of the container 32, the end strips of the material 40 are fastened to the end portions of the sidewalls 34 at several points, such as those indicated as 54.

Wherefore, having thus described my invention, I claim:

1. A cosmetic carrier adapted for use alone or for placement in the bottom of a larger container to contain a plurality of cosmetic containers from bumping and tipping in transit comprising:

(a) an open topped resiliently rigid container having sidewalls and a bottom;

(b) a vertically disposed ribbon of elastic material horizontally crisscrossing said container between a plurality of first points on one area of said sidewalls and a plurality of second points disposed between said first points on a second area of said sidewalls opposite said first area to create a plurality of generally triangular areas within said container, each of said areas being bounded on two sides by said elastic material and on a third side by a portion of said sidewalls;

(c) a plurality of first fastening means for fastening said elastic material to said sidewalls at said first and second points; and, (d) a plurality of releasable second fastening means attached to said elastic material at a plurality of opposed points along said material between said first and second points whereby said triangular areas can be releasably subdivided to contain smaller articles by fastening opposed ones of said fastening means.

2. The cosmetic carrier of claim 1 wherein:

said container is rectangular and said one area and said second area are opposed sides of said rectangular container.

3. The cosmetic carrier of claim 1 wherein:

said releasable fastening means comprises snap fasteners wherein two adjacent strips of said elastic material have a male portion of one of said snap fasteners on one said strip and a mating female portion of one of said snap fasteners on the other said strip.

4. The cosmetic carrier of claim 1 wherein:

said first fastening means are releasable fastening means whereby said elastic material can be removed from said container for cleaning.

5. A cosmetic carrier adapted for use alone or for placement in the bottom of a larger container to contain a plurality of cosmetic containers from bumping and tipping in transit comprising:

(a) an open topped resiliently rigid container having sidewalls and a bottom;

(b) a vertically disposed ribbon of elastic material horizontally crisscrossing said container between contact points on two areas of said sidewalls to create a serpentine path defining a plurality of generally triangular areas within said container, each of said areas being bounded on two sides by said elastic material and on a third side by a portion of said sidewalls;

(c) a plurality of first fastening means for fastening said elastic material to said sidewalls at said points of contact therewith; and, (d) a plurality of releasable second fastening means attached to said elastic material at a plurality of opposed points along said material between said points of contact whereby said triangular areas can be releasably subdivided to contain smaller articles by fastening opposed ones of said fastening means.

6. The cosmetic carrier of claim 5 wherein:

said container is rectangular and said two areas are opposed sides of said rectangular container.

7. The cosmetic carrier of claim 5 wherein:

said releasable fastening means comprises snap fasteners wherein two adjacent strips of said elastic material have a male portion of one of said snap fasteners on one said strip and a mating female portion of one of said snap fasteners on the other said strip.

8. The cosmetic carrier of claim 5 wherein:

said first fastening means are releasable fastening means whereby said elastic material can be removed from said container for cleaning.

* * * * *